US009901197B2

(12) United States Patent
Lucas et al.

(10) Patent No.: US 9,901,197 B2
(45) Date of Patent: Feb. 27, 2018

(54) MEMORY FOAM BLANKET

(71) Applicants: Mark Lucas, Grand Blanc, MI (US); Linda Lucas, Grand Blanc, MI (US)

(72) Inventors: Mark Lucas, Grand Blanc, MI (US); Linda Lucas, Grand Blanc, MI (US)

( * ) Notice: Subject to any disclaimer, the term of this patent is extended or adjusted under 35 U.S.C. 154(b) by 0 days.

(21) Appl. No.: 15/375,057

(22) Filed: Dec. 9, 2016

(65) Prior Publication Data

US 2017/0196381 A1 Jul. 13, 2017

Related U.S. Application Data

(60) Provisional application No. 62/276,880, filed on Jan. 10, 2016.

(51) Int. Cl.
*A47G 9/02* (2006.01)

(52) U.S. Cl.
CPC ..... *A47G 9/0207* (2013.01)

(58) Field of Classification Search
CPC ..... A47G 9/062; A47G 9/02; A47G 9/0207; A47G 9/0223; A47G 9/00; A47C 23/02; A47C 23/06; A47C 23/061; A47C 27/002; A47C 31/105; A47C 21/06; A63B 21/4037; A47D 15/003; A01K 1/0353
See application file for complete search history.

(56) References Cited

U.S. PATENT DOCUMENTS 429,894 A * 6/1890 Doremus ..... A47G 9/0207 5/485
2,087,505 A * 7/1937 Davis ..... A47G 9/0207 428/6
2,135,779 A * 11/1938 Zayotti ..... A47G 9/0207 2/274
2,727,242 A * 12/1955 Pascal ..... A47D 15/003 2/69
3,066,646 A * 12/1962 Bramley ..... A01K 1/0157 119/28.5
3,488,684 A * 1/1970 Wrightson ..... A47G 27/0225 112/420
3,528,874 A * 9/1970 Spencer ..... A41D 31/0038 156/279
3,541,620 A * 11/1970 Chapuis ..... A47G 9/0207 2/272
3,637,454 A * 1/1972 Pavernick ..... A47G 11/003 156/308.4
4,709,430 A * 12/1987 Nicoll ..... A47G 9/062 383/4
4,738,545 A * 4/1988 Westgor ..... A45C 9/00 190/1
5,457,829 A * 10/1995 Elliott ..... A47G 9/1045 5/420

(Continued)

*Primary Examiner* — Eric J Kurilla

(57) ABSTRACT

A bedding blanket comprising a layer of memory foam sandwiched between two outer layers of fabric. Stitching secures the three sandwiched layers together to maintain them in close proximity to each other. Stitching is located along the outer edge, in the creation of a hem, and in a sufficient manner across the body of the blanket to adequately secure the three layers together. The inclusion of memory foam enhances the usefulness of the blanket with an improved warming effect, when serving as padding to sit or lie upon, and when serving as a comfort/security object.

4 Claims, 2 Drawing Sheets

(56) References Cited

U.S. PATENT DOCUMENTS

| | | | | | |
|---|---|---|---|---|---|
| 5,685,257 | A * | 11/1997 | Feibus | A01K 1/0353 | 119/28.5 |
| 5,887,299 | A * | 3/1999 | Phillips | A47G 9/0207 | 5/413 R |
| 6,745,419 | B1 * | 6/2004 | Delfs | A47C 27/008 | 5/499 |
| 8,549,682 | B2 * | 10/2013 | Low | A47G 9/0207 | 5/501 |
| 9,102,127 | B2 * | 8/2015 | Berkowitz | A47G 9/062 | |
| 2005/0235420 | A1 * | 10/2005 | Keith | A41D 27/24 | 5/482 |
| 2005/0262634 | A1 * | 12/2005 | Gottlieb | A47G 9/1045 | 5/482 |
| 2006/0037143 | A1 * | 2/2006 | Green | A47C 7/021 | 5/653 |
| 2006/0174410 | A1 * | 8/2006 | Mastandrea, Jr. | A01K 1/0353 | 5/482 |
| 2007/0113349 | A1 * | 5/2007 | Oprandi | A47C 27/082 | 5/691 |
| 2012/0124740 | A1 * | 5/2012 | Castle | A47D 15/003 | 5/420 |
| 2014/0059769 | A1 * | 3/2014 | Baker | A61G 7/015 | 5/613 |
| 2016/0045043 | A1 * | 2/2016 | Tisius | A47G 9/0284 | 5/502 |

* cited by examiner

MEMORY FOAM BLANKET

CROSS REFERENCE TO RELATED APPLICATIONS

This application claims the benefit of provisional patent application 62/276,880 filed with a receipt date of Jan. 10, 2016 by the present inventors.

BACKGROUND OF THE INVENTION

Field of the Invention

The present invention relates to bedding and more specifically to blankets

Description of Related Art

The inventors have not found any pertinent related art, domestic or foreign, in the form of patents, patent applications, or commercial items.

Bedding blankets are available in a variety of styles and materials. They are generally similar in construction, basically comprising a rectangular shaped article of fabric with a hem around the perimeter. Various fabrics are used in the construction of a blanket, and a particular fabric is chosen to meet objectives such as cost, texture, weight, durability, esthetics, and laundering issues. Commonly used materials in the fabrication of blankets are fleece (natural or polyester), acrylic, polyester, cotton, or wool.

Blankets generally comprise a single layer of fabric; however, two layers of fabric may be used with a filler, such as a commonly used polyester fiberfill material (a blend of polyester fibers) sandwiched between them to enable increased insulation and therefore increased warmth for the user. As an example, fiberfill material is also used as insulation in jackets and comforters.

Primarily, a blanket is used by a person to cover oneself with to achieve a feeling of warmth and comfort. The warmth provided by a blanket is due to the insulating effect achieved by slowing down the loss of heat from the user's body, as well as retaining lost body heat within the blanket, and between the blanket and the user. The magnitude of the insulating effect depends upon the materials and structural design of the blanket.

A blanket can also act as padding to accomplish a cushioning effect when placed beneath the user. Although a blanket is most often used to cover one's body, there are times when a person may be in a situation where they are positioned on a hard surface such as the floor, the ground, or a hard seat or bench. In these situations, a blanket can be useful to act as a cushion between the hard surface and one's body. A blanket can be folded over multiple times to achieve a satisfactory amount of padding if the user will be resting on the blanket; however, the area covered by the blanket will then decrease each time the blanket is folded over. The amount of cushioning is dependent upon the materials used and the structural design of the blanket.

A blanket can serve as a comfort or security object in which case it can be hugged, or otherwise held in such a way as to comfort the user by satisfying various needs of the human psyche. The scientific community believes this can be important to a person's mental and emotional well-being. Adults as well as children have been found to benefit from the use of a comfort object such as a blanket. The term "security blanket" refers to this use.

Existing blankets generally fulfill one or more of the above features to various degrees, but there exists a need for a blanket which can more amply fulfill all of the above features to the greater benefit of a user. Many blankets are thin and are useful in mildly cool temperatures, but are not so effective at maintaining an adequate degree of warmth and comfort for an individual in excessively cold ambient temperatures. These relatively thin blankets are mainly useful when minimal warmth and protection from cold is needed. Since most available blankets are constructed of a single layer of fabric, they do not provide a high degree of cushioning for resting a person's body upon. Blankets filled with commonly used polyester fiberfill material improve upon the cushioning effect, but still do not inherently provide much in the way of a supportive, substantial means to cushion the body. Additionally, the objective of improving an individual's emotional well being with a comfort/security object is well known in the field of psychology, but this objective is generally not addressed with currently available blankets. Although any sort of blanket or object including stuffed animals can be used as a comfort object, the features that optimally afford this use with a blanket are lacking in the prior art.

BRIEF SUMMARY OF THE INVENTION

The blanket of this invention includes a layer of memory foam sandwiched between two outer layers of fabric. The inclusion of memory foam improves upon important functions of currently available blankets.

A blanket is thought to mainly be useful as a means of enabling a person to maintain a feeling of warmth when surrounding ambient air is uncomfortably cold. A blanket can also be useful as padding similar to a cushion to sit or lay upon, and as a comfort/security object to improve a person's emotional well being.

Memory foam is a dense material which does not readily allow air flow through it. Lack of airflow within memory foam mattresses and mattress toppers leads to a buildup of retained radiant heat and perspiration from a user which causes many people to feel uncomfortable. Although this heat retention is considered a disadvantage with mattresses and mattress toppers, it is an advantage with this invention. The addition of the relatively thin 5 mm thick memory foam layer within the blanket does an excellent job of trapping and retaining heat to keep a person comfortably warm without causing excess moisture and perspiration buildup.

There are times when a blanket is useful as padding to lie or sit upon. Common blankets are generally a single layer of fabric, and do not offer much in the way of padding, even when folded over multiple times. Blankets filled with polyester fiberfill type material do offer more padding than ordinary blankets, but not in the same, more effective way as the current invention. The Memory Foam Blanket of this invention provides for a more substantial and resilient degree of padding. Although the layer of memory foam is only 5 mm thick, when folded over multiple times, a substantial amount of padding is provided. Also, since memory foam is heat sensitive, it will conform to the user's body and adapt to the portion of their body in contact with the blanket. This is similar to the effect of lying upon a memory foam mattress.

The concept of a blanket serving as a comfort/security object is not generally considered in the blanket industry. There is a tremendous amount of scientific information available regarding the use of comfort objects to improve a person's emotional well being. Science has validated the indisputable benefits of how a comfort object improves the emotional well being of a person. The memory foam blanket described herein specifically addresses this principle and provides for a useful comfort object above and beyond that of existing blankets.

DETAILED DESCRIPTION OF THE INVENTION

Figure 1:
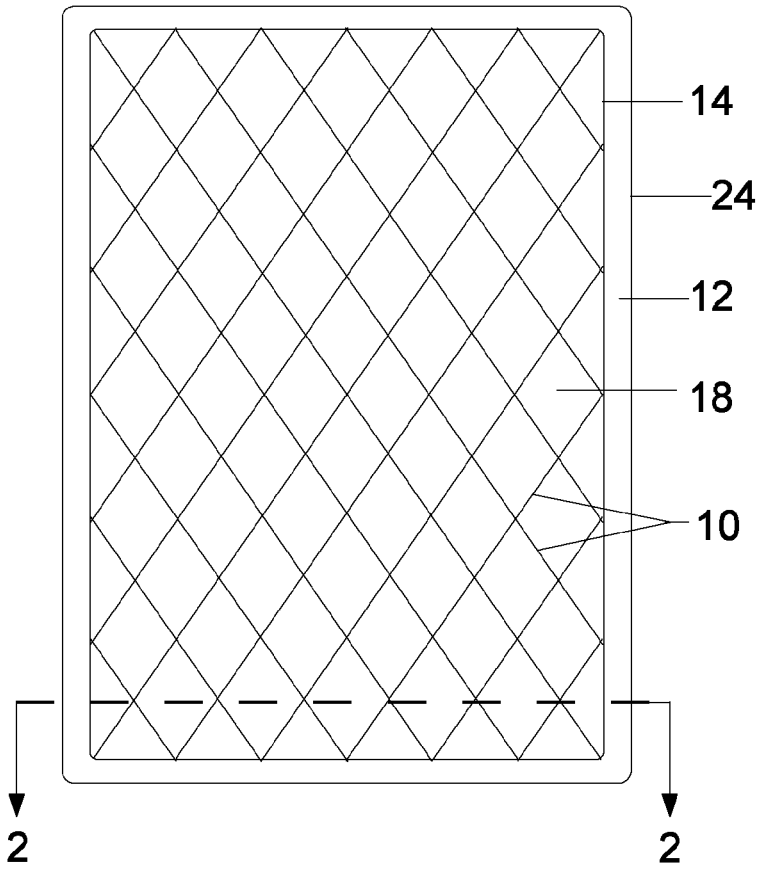
FIG. 1 shows a top plan view of the blanket when completely spread out flat.

FIG. 1 illustrates a top plan view of a preferred embodiment when it is spread out onto a flat surface, which is also representative of the bottom plan view. Fabric layer 18, which can be thought of as the top layer in this view, is comprised of 100 percent polyester microfleece fabric which is a commonly used fabric in blankets.

Figure 2:
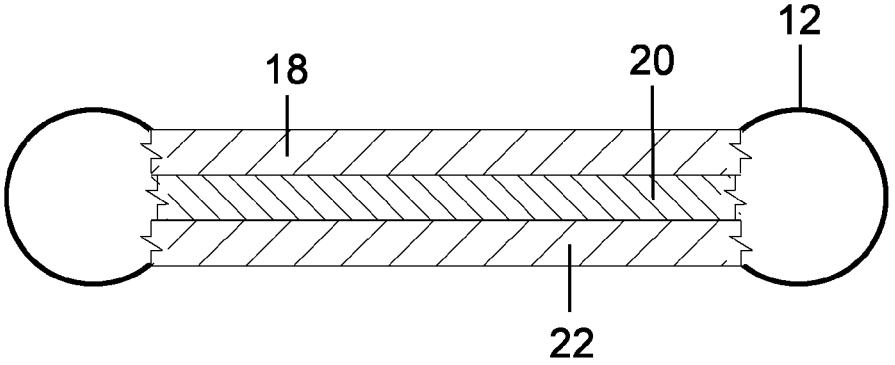
FIG. 2 shows a sectional view of the blanket.

FIG. 2 illustrates a sectional view of this embodiment. Memory foam layer 20 is sandwiched between fabric layer 18 and fabric layer 22. This preferred embodiment employs the same material for fabric layer 18 and fabric layer 22, although these two layers can also comprise different fabrics. Memory foam layer 20 is technically known as viscoelastic polyurethane foam. Memory foam can be of an open cell or closed cell nature, although modern memory foam is generally of an open cell structure. Open cell memory foam is utilized in this embodiment because of its advantageous properties pertinent to the features and benefits described herein.

Referring back to FIG. 1, stitching 14 passes completely through all three layers of the assembly and is located a predetermined distance from outer edge 24 of the assembly, thus creating hem 12.

FIG. 2 illustrates the roughly round shape of the hem created by the inclusion of fabric layer 18, fabric layer 22, and memory foam layer 20 into the hem, causing the hem to have a greater thickness than the remainder of the assembly. The fabrication process of this type of textile article results in a random configuration of the fabric and foam layers within the hem. The exact arrangement of these layers within the hem is not important to the structure of the hem and so is not detailed in the drawings. Memory foam layer 20 comprises an approximately 5 mm thick sheet of open cell memory foam of high density and low hardness, which effects maximum durability, as well as maximum softness. Various combinations of foam density and hardness can successfully be used. This 5 mm thickness nicely affords the benefits described herein, while keeping the weight and bulk of the blanket to a minimum. As the thickness of the memory foam used within the blanket increases, the stiffness of the blanket increases also, causing the blanket to be less pliable and less flexible. This effect on the stiffness is a consideration when selecting a thickness of memory foam. The 5 mm thick sheet of memory foam used in this embodiment adds minimal stiffness to the blanket, whereas a thicker sheet would add additional stiffness and bulk, and therefore may potentially be less appealing to a user. Also, based on current technology, fabricators are generally able to slice memory foam into sheets having a minimum thickness of approximately 5 mm.

Again referencing FIG. 1, stitching 10 comprises a plurality of diagonally oriented, parallel straight lines of stitching which pass through all three layers of the assembly and are spaced approximately 6 inches apart, thus forming a cross hatch pattern. Lines of stitching 10 connect opposite corners of the hem, and touch, but do not enter the hem. The main purpose of stitching 10 is to secure the three sandwiched layers together; however, the predetermined stitching design does also add an important element of esthetic appeal to the blanket. Alternative stitching designs can successfully be utilized.

Figure 3:
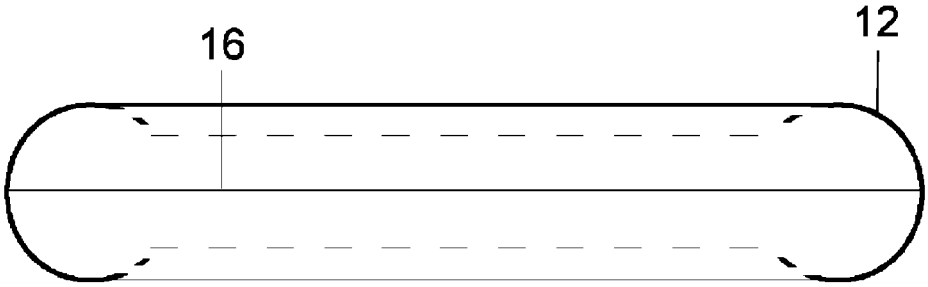
FIG. 3 shows an elevation view of the blanket which is relevant to all elevation views.

FIG. 3 illustrates an elevation view of a side of the blanket which is also representative of the other elevation views. Seam 16 is located at the outer edge of the assembly. Stitching of seam 16 is hidden behind the seam as a result of the typical method used in the textile industry to fabricate this type of article.

Figure 4:
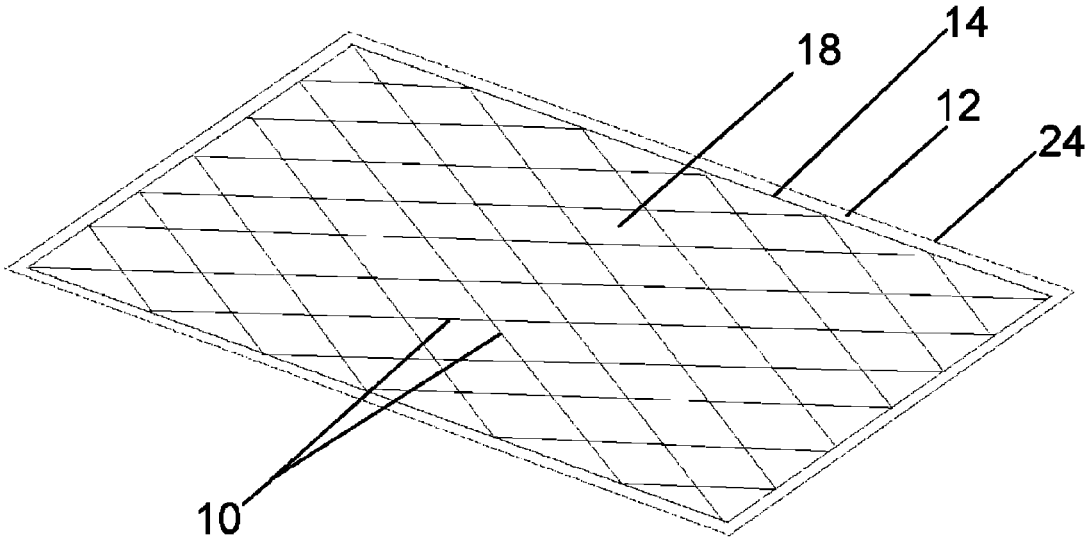
FIG. 4 shows a perspective view of the blanket.

FIG. 4 illustrates a perspective view of the blanket. The reference characters utilized in this view have already been explained in detail in connection with FIG. 1 earlier in this section.

LIST OF REFERENCE NUMBERS

10 Stitching of the cross hatch design
12 Hem
14 Stitching which creates and defines the hem
16 Seam at the outer edge of the hem
18 Fabric layer, described as the top fabric layer
20 Memory foam layer
22 Fabric layer
24 Outer edge of the assembly Brief Method of Construction:

A person skilled in the textile arts understands the method of construction of this type of article. There are no specialized steps or equipment needed beyond what is already commonly utilized in the field. This type of textile article is generally fabricated by positioning fabric layer 18 on a flat surface with the intended exterior surface facing up. Fabric layer 22 is aligned with and positioned on top of fabric layer 18 with the intended exterior surface facing down against fabric layer 18. Memory foam layer 20 is aligned with and positioned on top of fabric layer 22. Stitched seam 16 is created with a line of stitching located a predetermined distance from the outer edge of the assembly, fastening the three layers together except for a short distance along one edge, leaving an opening leading into the assembly. This predetermined distance will vary depending upon the ultimate predetermined size of the hem which is created at a later step. The assembly is then inverted by reaching between the two fabric layers and into the assembly, and then pulling the assembly inside out so the intended exterior surfaces of the fabric layers are now facing outward rather than inward, leaving the memory foam layer sandwiched between the two fabric layers. The small opening is then closed with additional stitching. A line of stitching 14 is located a predetermined distance from the outer edge of the assembly, and along the entire perimeter of the assembly, thus creating hem 12. Stitching 10 is then located in a predetermined cross hatch pattern across the breadth of the assembly to further secure the three layers together so they remain in close proximity to each other.

Alternative Embodiments

This invention is not meant to be limited in it's application to the construction of the preferred embodiment as explained in the detailed description and shown in the drawings herein. This invention is capable of other effective embodiments, and the dimensions, materials, specific construction, terminology, and language employed herein should not be regarded as limiting. Those skilled in the textile arts can appreciate that the concepts disclosed herein can be readily utilized as a basis for the design of other textile structures insofar as they do not depart from the spirit and scope of the present invention.

Although the preferred embodiment described above utilizes 100% polyester microfleece for both fabric layers, alternative embodiments can utilize a variety of suitable fabrics appropriate for a blanket including those made of synthetic fibers, natural fibers, or a blend thereof, and the fabric layers can also be of different materials.

The preferred embodiment includes a sheet of high density, low hardness, memory foam 5 mm in thickness; however, foam of an alternative thickness, density, and hardness can be effectively utilized. Current machinery is able to slice memory foam to a minimum thickness of approximately 5 mm; however, a lesser or greater thickness of memory foam can be utilized.

An important consideration is that an increased thickness of foam will increase the bulk and weight, and reduce the pliability of the blanket. Laundering may not be as effective, and drying times may be excessively long and impractical if the thickness of the foam is significantly greater than 5 mm.

Alternative open cell foam materials can be substituted for the memory foam layer. An appropriate foam material must be soft and pliable, and must tolerate laundering. Also, diverse grades of memory foam with various properties of density and hardness can be successfully used in the blanket. The minimum thickness achievable may vary depending upon the specific properties of a particular foam.

Various predetermined dimensions of width and length can be used in the fabrication of the blanket. The hem can also successfully comprise various widths, and thicknesses.

Lines of stitching 10 are necessary to secure the three layers of the blanket together while also providing visual appeal. There are many ways in which this stitching can be effectively designed. The orderly cross hatch stitching pattern in the preferred embodiment can be modified so the lines of stitching are closer together, or farther apart. This stitching can alternatively be of a pattern other than straight lines, and also can be located intermittently, or it can be any combination thereof. The important point is that stitching 10 must be arranged such that it effectively secures the three sandwiched layers together to avoid a loose assembly that may feel baggy when handled. Excessively spaced stitching may lead to excess movement between the three layers and may result in premature wear of the fabric, foam, and/or stitching.

Advantages:

Blankets serve several purposes including the following. They provide a degree of warmth when placed over or around a user, they provide a degree of cushioning when placed beneath a user, and they can be used as a comfort object to improve a person's emotional well being.

A preferred embodiment of the blanket described herein improves upon these qualities and therefore provides significant advantages over the prior art. The preferred embodiment of the blanket herein includes a 5 millimeter thick layer of memory foam sandwiched between two outer layers of soft microfleece fabric. This combination improves upon the insulation effect, cushioning effect, and increased enjoyment as a comfort object over the prior art.

Memory foam is known to act as an effective insulator. It retains lost body heat and therefore renders a feeling of warmth to a person when used in bedding items such as mattresses and mattress toppers. This heat retention is generally considered to be a disadvantage in these situations as excess heat can build up thus causing excessive perspiration and discomfort for the user. Manufacturers of memory foam mattresses and toppers have made modifications to help alleviate the heat retention problem. However, this warming effect of memory foam is a competitive advantage when used in a relatively thin layer in the memory foam blanket described herein.

Compared to the prior art, this blanket is more useful as a cushion to sit upon or as a pillow to rest one's head upon due to the supportive, yet resilient nature of the included layer of memory foam. The blanket herein can be used in a single layer or folded over multiple times so a user is resting upon multiple layers of the blanket to achieve a satisfactory cushioning effect. Due to the responsive properties of memory foam, the pressure and warmth of a person resting upon the memory foam blanket causes it to mold to the contours of the user, thus adding to their comfort and satisfaction.

Regarding the memory foam blanket serving as a comfort/security object, the memory foam layer within the blanket assembly helps provide for a feeling of firmness, bulk, weight, and solidity. These qualities effect a uniquely huggable article which is also pleasantly soft, cushiony, and substantial enough to embrace and cuddle. The relatively thick and rounded hem provides for a substantial edge which can be easily gripped, thus adding to the huggable and appealing nature of the blanket. This feature can more effectively benefit a user compared to the prior art. People love to hug and cuddle things such as pillows, blankets, and stuffed animals. A body pillow is a common example of a comfort object. Scientific evidence demonstrates there are numerous health benefits to hugging and cuddling, and that it is human nature to be drawn toward such behavior. Dr. Paul C. Horton, a psychiatrist who practices in Meriden, Conn. has been referenced in The New York Times, The Chicago Tribune, and has published several articles in the Bulletin of the Menninger Clinic which include his findings that people from childhood to adulthood benefit from comfort objects. A wealth of similar information is readily found in the public domain.

Additionally, an advantage of the memory foam layer is that it effects a long lasting retention of the fragrance of laundry products used with the blanket. The memory foam layer retains the fragrance of laundry products much longer than fabrics alone, thus giving the blanket an extended freshly laundered smell which can be appealing to people. The fragrance is easily removed by laundering the blanket with a fragrance free detergent or with plain water.

The practice of laundering a memory foam product in an automatic washing machine and automatic clothes dryer is typically discouraged in the memory foam business. Manufacturers and retailers of memory foam mattress toppers, wheelchair pads, pillows, and other similar items only recommend spot cleaning. Memory foam is a dense material which is of an open cell structure, meaning the tiny air spaces within the foam are interconnected enabling air and liquids to pass through the foam; however, the air spaces, called cells, are extremely tiny, and therefore do not readily allow the passage of air and liquids. It is logical to advise against laundering a memory foam item such as a mattress topper or a pillow which is typically at least 5 centimeters thick. The open cell structure of these items will retain a considerable amount of water and therefore can be quite heavy when wet. The excessive wet weight could possibly cause mechanical damage to washing and drying machines, and drying time could be very lengthy and impractical. The 5 mm thick sheet of memory foam utilized in the preferred embodiment is relatively thin and therefore water and air adequately pass through the foam layer allowing for effective washing and drying of the blanket. Test blankets have been laundered numerous times in an automatic washing machine and automatic clothes dryer with warm water wash cycles and medium heat drying cycles. There have not been any noticeable adverse effects to the structure or physical properties of the memory foam. Drying time is comparable to that of a heavy blanket.

Operation:

The preferred embodiment of the blanket described herein can be used by an individual to help keep warm when the surrounding ambient temperature is uncomfortably cool or cold. The blanket is draped over the individual, covering as much of their body as is deemed necessary to achieve the desired degree of comfort. Since the memory foam layer retains heat lost from the individual quite well, the blanket very effectively provides for warmth when used in cold ambient temperatures.

Due to the resilient, and substantial nature of the blanket, it can be used as a cushion to rest the body upon or as a pillow to rest one's head upon, especially when folded over multiple times so a user is resting upon several layers of the blanket.

Also, due to the resilient and substantial nature of the blanket, it can effectively be used as a comfort/security object. The blanket can be held in a single layer, or folded into multiple layers, or bunched up for increased thickness and bulk to create a variety of sizeable forms favorable for hugging or cuddling. Also, the blanket can be hugged, or positioned so as to rest between the legs, or held between the arms and the body. The relatively thick hem is substantial and can be readily grasped for positioning. There are many ways the blanket can be positioned and held.

We claim:

1. A blanket assembly comprising: a layer of foam, and two layers of a cloth fabric equal in planar size to the layer of foam, and the layer of foam aligned with and sandwiched between the two layers of fabric to form a sandwich, and the sandwich secured together with a first stitching along the most lateral aspect of the entire perimeter of the assembly, and the sandwich secured together by a second stitching that passes completely through the three layers, and is located a predetermined distance from the perimeter of the sandwich, thus creating a hem, and the sandwich secured together with a third stitching that passes completely through the layers of foam and fabric and is sufficiently arranged across the breadth of the planar surface of the assembly so as to maintain the sandwiched foam layer in close proximity to the two fabric layers, and the hem being of a greater thickness than the total combined thickness of the sandwich, and wherein the foam layer comprises open cell visco-elastic polyurethane foam and is approximately 5 mm thick.

2. The blanket assembly of claim 1 wherein the third stitching comprises a cross hatch pattern arranged diagonally across the breadth of the planar surface of the blanket assembly with lines of the stitching spaced apart at predetermined intervals.

3. The blanket assembly of claim 1 wherein the layers of fabric comprise microfleece.

4. The blanket assembly of claim 1 wherein the foam layer comprises a sheet of foam.

* * * * *